US009091267B2

(12) United States Patent
Henderson, Jr. et al.

(10) Patent No.: US 9,091,267 B2
(45) Date of Patent: Jul. 28, 2015

(54) CONTROLLER FOR VARYING FLOW RATE FROM FIXED DISPLACEMENT PUMP

(71) Applicant: Caterpillar Inc., Peoria, IL (US)

(72) Inventors: Russell Ross Henderson, Jr., Havana, IL (US); Abdul Karim Maoued, Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 45 days.

(21) Appl. No.: 13/936,270

(22) Filed: Jul. 8, 2013

(65) Prior Publication Data

US 2015/0010416 A1 Jan. 8, 2015

(51) Int. Cl.

| | |
|---|---|
| ***F16H 47/04*** | (2006.01) |
| ***F04C 14/08*** | (2006.01) |
| ***F04C 2/08*** | (2006.01) |

(52) U.S. Cl.

CPC . *F04C 14/08* (2013.01); *F04C 2/08* (2013.01); *Y10T 29/49236* (2015.01); *Y10T 29/49242* (2015.01); *Y10T 29/49243* (2015.01); *Y10T 29/49245* (2015.01)

(58) Field of Classification Search

CPC ... F04C 14/24; F04C 15/06; Y10T 29/49242; Y10T 29/49245; Y10T 29/49236; Y10T 29/49243

USPC ..... 475/31, 59, 61, 91, 93, 116; 60/494

See application file for complete search history.

(56) References Cited

U.S. PATENT DOCUMENTS

| | | | | |
|---|---|---|---|---|
| 2,995,049 | A * | 8/1961 | Bolliger | 475/77 |
| 3,302,487 | A * | 2/1967 | Kempson | 477/68 |
| 3,397,597 | A * | 8/1968 | Szekely | 475/107 |
| 4,672,863 | A * | 6/1987 | Itoh et al. | 477/41 |
| 4,813,306 | A * | 3/1989 | Kita et al. | 475/80 |
| 7,901,314 | B2 | 3/2011 | Salvaire et al. | |
| 2009/0088280 | A1 | 4/2009 | Warren | |
| 2009/0208358 | A1 | 8/2009 | Yamashita et al. | |

FOREIGN PATENT DOCUMENTS

| | | |
|---|---|---|
| KR | 100217081 | 9/1999 |

* cited by examiner

*Primary Examiner* — Justin Holmes
*Assistant Examiner* — Tinh Dang
(74) *Attorney, Agent, or Firm* — Finnegan, Henderson, Farabow, Garrett & Dunner, LLP

(57) ABSTRACT

A controller for varying flow rate of a fluid from a fixed displacement pump is provided. The controller includes a pump speed control gear set, a ratio control pump, and a relief valve. The pump speed control gear set includes a sun gear configured to be driven by a prime mover, a planet carrier including one or more planet gears meshed with the sun gear, and a ring gear meshed with the planet gears. The ring gear is configured to connect to an input shaft of the fixed displacement pump. The ratio control pump includes a stationary body, and a rotor coupled to the planet carrier of the pump speed control gear set. The rotor is configured to co-act with the body to pump fluid. The relief valve is connected to the ratio control pump and configured to restrict fluid egress from the ratio control pump.

20 Claims, 3 Drawing Sheets

CONTROLLER FOR VARYING FLOW RATE FROM FIXED DISPLACEMENT PUMP

TECHNICAL FIELD

The present disclosure relates to a controller, and more particularly to a controller for varying flow rate from a fixed displacement pump.

BACKGROUND

Many applications may employ variable displacement pumps to vary a flow rate of a fluid while delivering pressurized fluid. Some variable displacement pumps including but not limited to, axial piston pumps may be expensive and difficult to maintain while operating under contaminated environments in which the fluid may become dirty easily. Another phenomenon observed in such pumps may be fluid cavitation caused by aeration of the fluid.

Many of the foregoing pumps may be characterized by lower tolerances towards cavitation, and/or may be susceptible to contamination of fluid by dirt, particulate matter, or any other impurity. Hence, the performance of these pumps may deteriorate upon prolonged use of the pump in contaminated or aerated environments.

U.S Publication No. 2009/0088280 relates to a variable displacement gear pump device. The variable displacement gear pump provides variable flow while retaining the advantages generally associated with gear pumps, and without diverting pressurized fluid back to the pump inlet. In one embodiment, a gear pump includes a first gear and a second gear forming an external pump, the first gear rotatable about a fixed axis and drivingly engaging the second gear, the second gear rotating about its central axis and selectively movable in an epicyclical relationship with the first gear whereby the discharge of the pump is varied.

The present disclosure is directed to mitigating or eliminating one or more of the drawbacks discussed above.

SUMMARY

In one aspect, the present disclosure provides a controller for varying flow rate of a fluid from a fixed displacement pump. The controller includes a pump speed control gear set, a ratio control pump, and a relief valve. The pump speed control gear set includes a sun gear, a planet carrier, and a ring gear. The sun gear is configured to be driven by a prime mover. The planet carrier includes one or more planet gears meshed with the sun gear. The ring gear is meshed with the planet gears and is configured to connect to an input shaft of the fixed displacement pump. The ratio control pump includes a stationary body, and a rotor coupled to the planet carrier of the pump speed control gear set. The rotor is configured to co-act with the body to pump fluid. The relief valve is connected to the ratio control pump and configured to restrict fluid egress from the ratio control pump.

In another aspect, the present disclosure provides a variable flow pump system including a fixed displacement pump, and a controller. The fixed displacement pump includes at least a first co-acting member, and a second co-acting member. The second co-acting member is coupled with an input shaft thereto and is disposed in rotational relation to the first co-acting member. The controller includes a pump speed control gear set, a ratio control pump, and a relief valve. The pump speed control gear set includes at least a sun gear, a planet carrier, and a ring gear. The sun gear is configured to be driven by a prime mover. The planet carrier includes one or more planet gears meshed with the sun gear. The ring gear is meshed with the planet gears and is configured to connect to the input shaft of the fixed displacement pump. The ratio control pump includes a stationary body, and a rotor coupled to the planet carrier of the pump speed control gear set. The rotor is configured to co-act with the body to pump fluid. The relief valve is connected to the ratio control pump and configured to restrict fluid egress from the ratio control pump.

In another aspect, the present disclosure provides a method of making a variable flow pump system. The method includes coupling an input shaft of a fixed displacement pump with a ring gear of a pump speed control gear set. The pump speed control gear set includes one or more planet gears and a sun gear in mesh with each other while the planet gears are held by a planet carrier. The method further includes coupling a rotor of a ratio control pump to the planet carrier of the pump speed control gear set. The ratio control pump includes a body configured to co-act with the rotor to pump fluid. The method further includes connecting a relief valve downstream of the ratio control pump.

In another aspect, the present disclosure provides a method of varying flow rate of fluid from a fixed displacement pump. The method includes driving a sun gear of a pump speed control gear set to operatively rotate a ring gear, and planet gears therein while the ring gear is coupled to an input shaft of the fixed displacement pump. The method further includes driving a rotor of a ratio control pump to co-act with a body of the ratio control pump while the rotor is coupled to a planet carrier associated with the planet gears of the pump speed control gear set. The method further includes pumping fluid within the ratio control pump by rotation of the planet carrier. The method further includes restricting fluid egress from the ratio control pump by a relief valve.

Other features and aspects of this disclosure will be apparent from the following description and the accompanying drawings.

DETAILED DESCRIPTION

Figure 1:
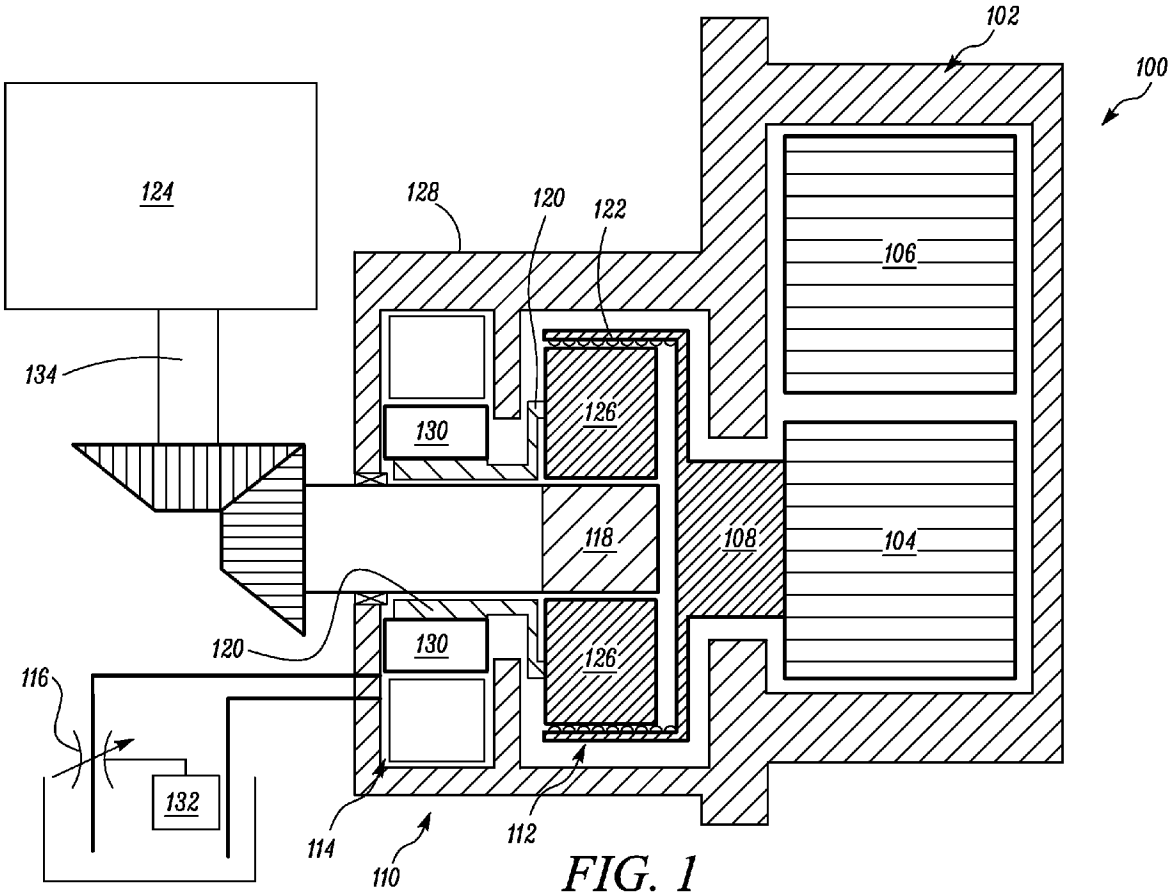
FIG. 1 is a schematic of an exemplary variable flow pump system in accordance with an embodiment of the present disclosure.

The present disclosure relates to a controller for varying flow rate from a fixed displacement pump. FIG. 1 shows a schematic of a variable flow pump system 100, in which disclosed embodiments can be implemented. The variable flow pump system 100 includes a fixed displacement pump 102 including at least a first co-acting member 104, and a second co-acting member 106. The first co-acting member 104 is coupled with an input shaft 108 thereto and is disposed in rotational relation to the second co-acting member 106. In an embodiment, the fixed displacement pump 102 can be a rotary pump such as but not limited to, a vane pump, a gear pump, an impeller pump, or a gerotor pump. In an exemplary embodiment as shown in FIG. 1, the fixed displacement pump 102 is a gear pump in which the first co-acting member 104 can be a first gear, while the second co-acting member 106 can be a second gear disposed in rotational relation to the first gear.

The variable flow pump system 100 can further include a controller 110 for varying flow rate of the fixed displacement pump 102. The controller 110 can include a pump speed control gear set 112, a ratio control pump 114, and a relief valve 116. The pump speed control gear set 112 includes a sun gear 118, a planet carrier 120, and a ring gear 122. The sun gear 118 can be configured to be driven by a prime mover 124 including but not limited to an engine. The planet carrier 120 includes one or more planet gears 126 meshed with the sun gear 118. The ring gear 122 is meshed with the planet gears 126 and can be connected to the input shaft 108 of the fixed displacement pump 102. In the embodiment as shown in FIG. 1, the ring gear 122 is connected to the first co-acting member 104.

In an embodiment, the pump speed control gear set 112 can be embodied as a simple planetary gear set. Alternatively, the pump speed control gear set 112 can be embodied as a compound planetary gear set. In other embodiments, the compound planetary gear set can be embodied as one of a Simpson planetary gear set, and a Ravigneaux planetary gear set. The compound planetary gear set according to any one or more of the foregoing embodiments and/or additional or alternative embodiments may be used when a wide a range of gear ratios in the pump speed control gear set 112 may be required to cause a wide range of displacement outputs in the fixed displacement pump 102. Hence, it is to be noted that a type of the pump speed control gear set 112 disclosed herein may change based on specific requirements of an application. Therefore, a scope of implementation of the controller 110 is not limited to the specific embodiments disclosed herein, but may extend to include other types of pump speed control gear sets 112. The pump speed control gear set 112 may be configured to restrict relatively moving parts of the pump speed control gear set 112 and consequently vary the flow output in the fixed displacement pump 102 as will be further explained herein.

The ratio control pump 114 can include a stationary body 128, and a rotor 130. The rotor 130 is coupled to the planet carrier 120 of the pump speed control gear set 112, and the rotor 130 can co-act with the body 128 to pump fluid. In one embodiment, the ratio control pump 114 is a rotary pump selected from one of vane pump, gear pump, impeller pump, and gerotor pump. In an exemplary embodiment as shown in FIG. 1, the ratio control pump 114 may be a vane pump including a vaned rotor, and the stationary body 128. The vaned rotor may include spring loaded vanes (not shown) therein that follow an elliptical motion within the stationary body 128 to accomplish the pumping of fluid.

Although the present disclosure discloses that the sun gear 118 can be driven by the prime mover 124, the planet carrier 120 can be coupled to the rotor 130 and the ring gear 122 can be connected to the first co-acting member 104 of the fixed displacement pump 102, in an alternative embodiment, the ring gear 122 can be driven by the prime mover 124, the planet carrier 120 can be coupled to the rotor 130 and the sun gear 118 can be connected to the first co-acting member 104 of the fixed displacement pump 102. In such an alternative embodiment, the ring gear 122 of the pump speed control gear set 112 is configured to transfer output power from the prime mover 124 instead of the sun gear 118. Hence, it is to be noted that connections of the prime mover 124 and the ratio control pump 114 to various parts of the pump speed control gear set 112 disclosed herein may change based on specific requirements of an application. A person having ordinary skill in the art having the benefit of teachings in this specification, may effect numerous modifications thereto and changes may be made without departing from the scope and spirit of the present disclosure.

In an other embodiment, the pump speed control gear set 112 can be a differential gear set whereby the prime mover 124 can rotate a first side gear of the differential gear set while a second side gear of the differential gear set can be configured to deliver output power of the prime mover 124. In such an embodiment, the differential carrier of the differential gear set can be restricted by the rotor 130 of the ratio control pump 114 such that a gear ratio of the differential gear set can be varied. Thus, a scope of implementation of the controller 110 is not limited to the specific embodiments disclosed herein, but may extend to be implemented in conjunction with other types of pump speed control gear sets 112 such that relatively moving parts of the pump speed control gear set 112 may be restricted to vary a gear ratio of the pump speed control gear set 112, and hence, vary the flow of fluid from the fixed displacement pump 102.

The relief valve 116 is connected to the ratio control pump 114 and can restrict fluid egress from the ratio control pump 114. In an embodiment, the rotor 130 of the ratio control pump 114 is configured to slip with respect to the body 128 while the relief valve 116 selectively restricts fluid egress from the ratio control pump 114. In an embodiment, the relief valve 116 is configured to restrict fluid egress such that the rotor 130 is resisted from moving relative to the body 128 thereby varying flow rate of fluid from the fixed displacement pump 102.

In an embodiment as shown in FIG. 1, the relief valve 116 can be a solenoid operated relief valve 116 controlled by an electronic control module (ECM) 132. The ECM 132 can be programmed with one or more pre-defined release pressure limits at which the ECM 132 may configure the relief valve 116 to open and allow fluid egress from the ratio control pump 114.

In an exemplary mode of working, the sun gear 118 of the pump speed control gear set 112 may be driven at a first engine speed. The sun gear 118 may thus, transfer all of the engine power into rotating the planet gears 126, the planet carrier 120, and the ring gear 122 of the pump speed control gear set 112 at speeds relatively corresponding to the first engine speed. The rotating planet carrier 120 of the pump speed control gear set 112 may rotate the rotor 130 of the ratio control pump 114. The ratio control pump 114 may be simultaneously pumping a volume of fluid due to rotation of the rotor 130 relative the stationary body 128.

At this point, the relief valve 116 may be actuated to restrict a fluid egress from the ratio control pump 114. This causes pressure build-up within the ratio control pump 114 thus resisting the rotor 130 from rotating relative to the stationary body 128. Resisting the rotation of the rotor 130 may cause a reduction in the rotational speed of the rotor 130 and thus, the rotational speed of the planet carrier 120 coupled to the rotor 130. Therefore, the resisted planet carrier 120 cannot free-wheel and consequently cannot shed speed coming from the rotating sun gear 118 driven by the prime mover 124.

Consequently, the ring gear 122 now starts to move and rotate at a higher speed closer to the first engine speed of the sun gear 118. A change in rotational speed of the ring gear 122 causes an increase in rotational speed of the first co-acting member 104 of the fixed displacement pump 102. Increase in rotational speed of the first co-acting member 104 will cause the second co-acting member 106 to co-operatively rotate at an increased speed in place of an original speed achieved purely from rotating the sun gear 118 at the first engine speed by the engine. Thus, gains in speed of the first and the second co-acting members 104, 106 may produce a larger volume of displaced fluid exiting the fixed displacement pump 102.

A volume of fluid output from the fixed displacement pump 102 may depend on an amount of restriction offered by the relief valve 116 to the fluid egress from the ratio control pump 114. A higher volume of fluid output may be obtained from the fixed displacement pump 102 by increasing the restriction to the fluid egress from the ratio control pump 114. Conversely, a lower volume of fluid output may be obtained from the fixed displacement pump 102 by reducing the restriction to the fluid egress from the ratio control pump 114. Therefore, by varying the restriction of the fluid egress from the ratio control pump 114 at the relief valve 116, a variation in the volume of fluid output from the fixed displacement pump 102 may be accomplished. In this manner, the fixed displacement pump 102 may be configured to deliver varying volume outputs and form the variable flow pump system 100 when used in conjunction with the controller 110 of the present disclosure.

In an embodiment, a machine (not shown) including the prime mover 124 and having an output drive shaft 134 may employ the variable flow pump system 100. The output drive shaft 134 of the machine may be coupled to the sun gear 118 of the pump speed control gear set 112. Further, the prime mover 124 can be the engine, as disclosed earlier herein, or in alternative embodiments of the present disclosure, the prime mover 124 can be an electric motor, wind or water turbine. Upon employing the variable flow pump system 100 of the present disclosure in the machine, the output drive shaft 134 of the machine may rotate at a uniform speed to rotate the sun gear 118 of the pump speed control gear set 112 at the uniform speed. However, any changes to the displacement of fluid from the fixed displacement pump 102 may be accomplished through a variation in restriction of the fluid egress from the ratio control pump 114 by the relief valve 116.

INDUSTRIAL APPLICABILITY

Figure 2:
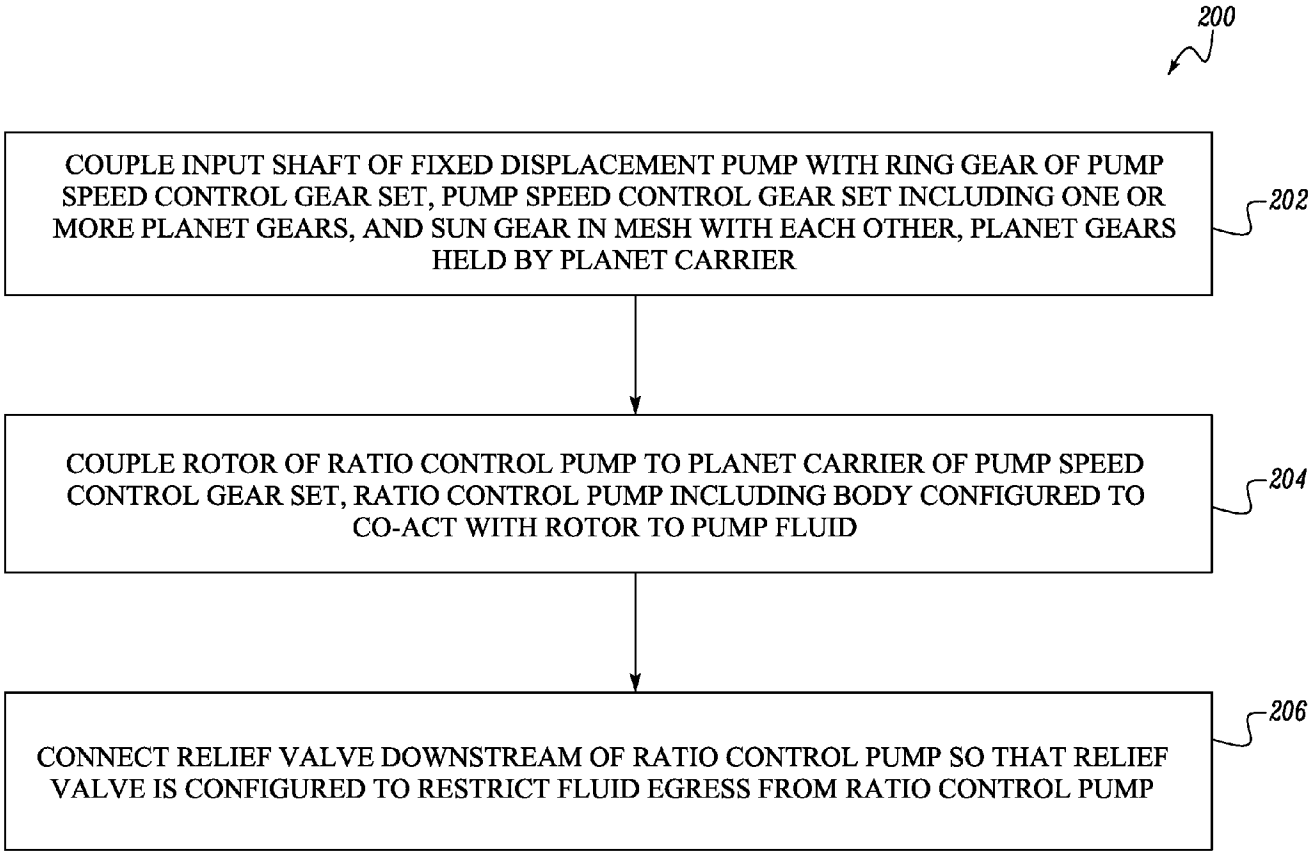
FIG. 2 is a flow diagram illustrating an exemplary method of making the variable flow pump system of FIG. 1.

FIG. 2 shows a method 200 of making the variable flow pump system 100. At step 202, the method 200 includes coupling the input shaft 108 of the fixed displacement pump 102 with the ring gear 122 of the pump speed control gear set 112, the pump speed control gear set 112 including the planet gears 126 and the sun gear 118 in mesh with each other, the planet gears 126 held by the planet carrier 120. At step 204, the method 200 further includes coupling the rotor 130 of the ratio control pump 114 to the planet carrier 120 of the pump speed control gear set 112, the ratio control pump 114 including the body 128 configured to co-act with the rotor 130 to pump fluid. At step 206, the method 200 further includes connecting the relief valve 116 downstream of the ratio control pump 114 so that the relief valve 116 can be configured to restrict fluid egress from the ratio control pump 114.

In an embodiment of making the variable flow pump system 100, the method 200 includes selecting a rotary pump such as a vane pump, a gear pump, an impeller pump or a gerotor pump to form the fixed displacement pump 102. In another embodiment of making the variable flow pump system 100, the method 200 includes selecting a rotary pump such as a vane pump, a gear pump, an impeller pump, or a gerotor pump to form the ratio control pump 114.

In another embodiment of making the variable flow pump system 100, the method 200 includes selecting a simple planetary gear set, or a compound planetary gear set to form the pump speed control gear set 112. In one embodiment, the compound planetary gear set is formed from a Simpson planetary gear set. In another embodiment, the compound planetary gear set is formed from a Ravigneaux gear set.

Many applications employ variable displacement pumps to vary a flow rate of a fluid while delivering pressurized fluid. Some variable displacement pumps including but not limited to, axial piston pumps have tight running clearances and involve reciprocating motions. Such variable displacement pumps are expensive and difficult to maintain while operating under contaminated environments in which the fluid may become dirty easily. Another phenomenon observed in pumps is fluid cavitation caused by aeration of the fluid.

Various traditional pumps may be characterized by lower tolerances towards cavitation, and/or may be susceptible to contamination of fluid by dirt, particulate matter, or any other impurity. Hence, a performance of these pumps may deteriorate upon prolonged use of the pump in contaminated or aerated environments.

With reference to the variable flow pump system 100 of the present disclosure, commonly known rotary pumps such as the gear pump, the impeller pump, and the gerotor pump are selected to form the fixed displacement pump 102, and the ratio control pump 114. These rotary pumps are typically of a sturdier construction as compared to many axial piston pumps commonly known in the art. Therefore, the variable flow pump system 100 may be rugged, and hence, capable of handling the contamination or cavitation issues. Thus, with use of the variable flow pump system 100 of the present disclosure, the issues of contamination and cavitation therein are mitigated thereby doing away with use of expensive conventionally known variable displacement pumps. Further, the costs incurred in repairs and replacement of previously known variable displacement pumps may be substantially reduced.

Further, when implementing the variable flow pump system 100 onto the prime mover 124 of the machine, the prime mover 124 may rotate at any speed without encountering a load or fatigue in accomplishing the slower rotational speed of the first and second co-acting members 104, 106 to reduce the flow rate from the fixed displacement pump 102. The load or fatigue previously experienced by prime movers is now manifested into the varying rotational speeds of the sun gear 118, the planet gears 126, and the ring gear 122 of the pump speed control gear set 112 thus prolonging a service life of the prime mover 124. Therefore, use of the variable flow pump system 100 of the present disclosure increases overall profitability over prolonged use.

Figure 3:
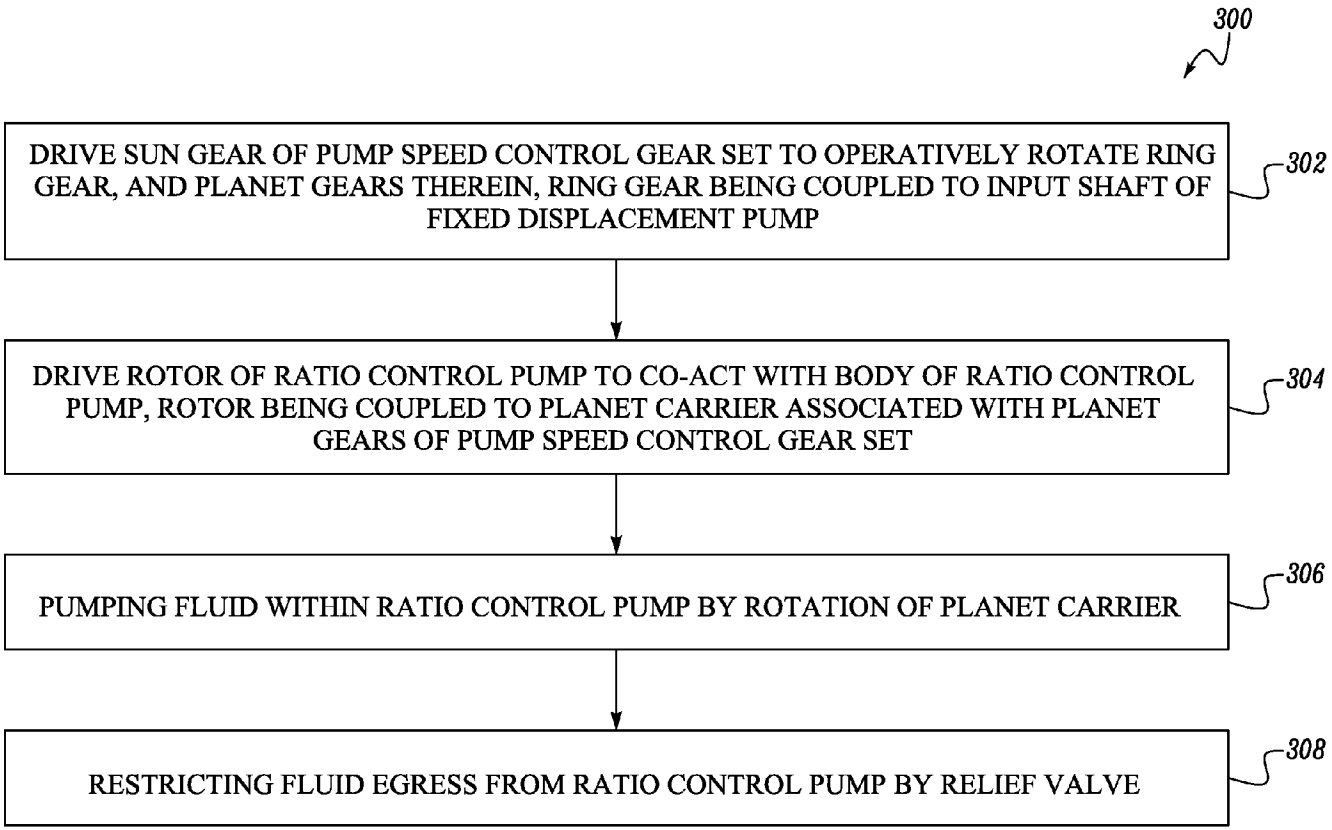
FIG. 3 is a flow diagram illustrating an exemplary method of varying flow rate of fluid from a fixed displacement pump.

FIG. 3 shows a method 300 of varying flow rate of fluid from the fixed displacement pump 102. At step 302, the method 300 includes driving the sun gear 118 of the pump speed control gear set 112 to operatively rotate the ring gear 122, and planet gears 126 therein, the ring gear 122 being coupled to the input shaft 108 of the fixed displacement pump 102. At step 304, the method 300 further includes driving the rotor 130 of the ratio control pump 114 to co-act with the body 128 of the ratio control pump 114, the rotor 130 being coupled to the planet carrier 120 associated with the planet gears 126 of the pump speed control gear set 112. At step 306, the method 300 further includes pumping fluid within the ratio control pump 114 by rotation of the planet carrier 120. At step 308, the method 300 further includes restricting the fluid egress from the ratio control pump 114 by the relief valve 116, wherein restricting the fluid egress causes a variation in the rotational speed of the second co-acting member 106 and the first co-acting member 104 of the fixed displacement pump 102. In an embodiment, the method 300 can include slipping the rotor 130 with respect to the body 128 while restricting fluid egress from the ratio control pump 114.

While aspects of the present disclosure have been particularly shown and described with reference to the embodiments above, it will be understood that various additional embodiments may be contemplated by the modification of the disclosed machine, systems and methods without departing from the spirit and scope of what is disclosed. Such embodiments should be understood to fall within the scope of the present disclosure as determined based upon the claims and any equivalents thereof.

We claim:

1. A controller for varying flow rate of a fixed displacement pump, the controller comprising:

a pump speed control gear set including at least:

a sun gear configured to be driven by a prime mover;

a planet carrier including one or more planet gears meshed with the sun gear; and a ring gear meshed with the planet gears and configured to connect to an input shaft of the fixed displacement pump; and a ratio control pump including:

a stationary body; and a rotor coupled to the planet carrier of the displacement control gear set and configured to co-act with the body to pump fluid; and a relief valve connected to the ratio control pump and configured to restrict fluid egress from the ratio control pump.

2. The controller of claim 1, wherein the rotor is configured to slip with respect to the body while the relief valve selectively restricts fluid egress from the ratio control pump.

3. The controller of claim 1, wherein the relief valve of the ratio control pump is configured to restrict fluid egress such that flow rate of the fixed displacement pump is varied.

4. The controller of claim 1, wherein the pump speed control gear set is a simple planetary gear set.

5. The controller of claim 1, wherein the ratio control pump is a rotary pump selected from one of vane pump, gear pump, impeller pump, and gerotor pump.

6. A variable flow pump system comprising:

a fixed displacement pump including at least:

a first co-acting member; and a second co-acting member coupled with an input shaft thereto, the second co-acting member disposed in rotational relation to the first co-acting member;

a controller including:

a pump speed control gear set including at least:

a sun gear configured to be driven by a prime mover;

a planet carrier including one or more planet gears meshed with the sun gear; and a ring gear meshed with the planet gears and configured to connect to the input shaft of the fixed displacement pump; and a ratio control pump including:

a stationary body; and a rotor coupled to the planet carrier of the displacement control gear set and configured to co-act with the body to pump fluid; and a relief valve connected to the ratio control pump and configured to restrict fluid egress from the ratio control pump.

7. The variable flow pump system of claim 6, wherein the rotor is configured to slip with respect to the body while the relief valve selectively restricts fluid egress from the ratio control pump.

8. The variable flow pump system of claim 6, wherein the relief valve of the ratio control pump is configured to restrict fluid egress such that flow rate from the fixed displacement pump is varied.

9. The variable flow pump system of claim 6, wherein the pump speed control gear set is one of a simple planetary gear set.

10. The variable flow pump system of claim 6, wherein the fixed displacement pump is a rotary pump selected from one of vane pump, gear pump, impeller pump, and gerotor pump.

11. The variable flow pump system of claim 6, wherein the ratio control pump is a rotary pump selected from one of vane pump, gear pump, impeller pump, and gerotor pump.

12. A machine including:

a prime mover having an output drive shaft; and employing the variable flow pump system of claim 6, wherein the output drive shaft is coupled to the sun gear of the pump speed control gear set.

13. The machine of claim 12, wherein the prime mover is one of an engine, and an electric motor.

14. A method of making a variable flow pump system, the method comprising:

coupling an input shaft of a fixed displacement pump with a ring gear of a pump speed control gear set, the pump speed control gear set including one or more planet gears, and a sun gear in mesh with each other, the planet gears held by a planet carrier;

coupling a rotor of a ratio control pump to the planet carrier of the pump speed control gear set, the ratio control pump including a body configured to co-act with the rotor to pump fluid; and connecting a relief valve downstream of the ratio control pump.

15. The method of claim 14, wherein the pump speed control gear set is a simple planetary gear set.

16. The method of claim 14, wherein the fixed displacement pump is a rotary pump selected from one of vane pump, gear pump, impeller pump, and gerotor pump.

17. The method of claim 14, wherein the ratio control pump is a rotary pump selected from one of vane pump, gear pump, impeller pump, and gerotor pump.

18. A method of varying flow rate of fluid from a fixed displacement pump, the method including:

driving a sun gear of a pump speed control gear set to operatively rotate a ring gear, and planet gears therein, the ring gear being coupled to an input shaft of the fixed displacement pump;

driving a rotor of a ratio control pump to co-act with a body of the ratio control pump, the rotor being coupled to a planet carrier associated with the planet gears of the pump speed control gear set;

pumping fluid within the ratio control pump by rotation of the planet carrier; and restricting fluid egress from the ratio control pump by a relief valve.

19. The method of claim 18, wherein restricting fluid egress includes varying a rotational speed of a second co-acting member in relation to a first co-acting member of the fixed displacement pump.

20. The method of claim 18 further including slipping a rotor with respect to a body while selectively restricting fluid egress from the ratio control pump.

* * * * *